US008701859B2

(12) United States Patent
Takashima

(10) Patent No.: US 8,701,859 B2
(45) Date of Patent: Apr. 22, 2014

(54) SHUTTER STRUCTURE AND AUTOMATIC TRANSACTION APPARATUS

(75) Inventor: Takuro Takashima, Kobe (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 13/504,940

(22) PCT Filed: Dec. 1, 2010

(86) PCT No.: PCT/JP2010/071497

§ 371 (c)(1),
(2), (4) Date: Apr. 27, 2012

(87) PCT Pub. No.: WO2011/086781

PCT Pub. Date: Jul. 21, 2011

(65) Prior Publication Data

US 2012/0210916 A1 Aug. 23, 2012

(30) Foreign Application Priority Data

Jan. 13, 2010 (JP) ..... 2010-005301

(51) Int. Cl.
*G07D 11/00* (2006.01)
*E05G 1/026* (2006.01)

(52) U.S. Cl.
USPC ..... 194/348; 109/64; 49/501

(58) Field of Classification Search
USPC ..... 194/344, 345, 347, 348, 350; 52/198, 52/199, 302.1; 232/22, 44; 221/282; 109/1 R, 64, 66; 193/DIG. 1; 312/100, 312/138.1, 229; 49/408, 476.1, 501, 504; 235/1 A; 902/30
See application file for complete search history.

(56) References Cited

U.S. PATENT DOCUMENTS

| | | | | |
|---|---|---|---|---|
| 4,251,009 | A * | 2/1981 | McLaughlin et al. | 221/12 |
| 6,752,367 | B2 * | 6/2004 | Yamashita et al. | 248/312 |
| 2003/0193273 | A1 | 10/2003 | Yamashita et al. | |

FOREIGN PATENT DOCUMENTS

| | | | |
|---|---|---|---|
| CN | 1450501 | A | 10/2003 |
| JP | 63-053176 | U | 4/1988 |
| JP | 6-282724 | A | 10/1994 |
| JP | 2003-303366 | A | 10/2003 |
| JP | 2003-346213 | A | 12/2003 |
| JP | 3959297 | B | 8/2007 |
| JP | 2009-211575 | A | 9/2009 |

OTHER PUBLICATIONS

Foreign Office Action Application No. 201080048225.4, (11 pages) issued on Feb. 12, 2014 with partial English translation.

* cited by examiner

*Primary Examiner* — Mark Beauchaine
(74) *Attorney, Agent, or Firm* — Rabin & Berdo, P.C.

(57) ABSTRACT

The present invention prevents water or the like from collecting on a shutter face by having a sufficient water discharge capability without requiring a bulky water discharge structure, in an automatic transaction apparatus that deposits and withdraws money by opening and closing the shutter. Namely, includes a sloping profile shutter having side wall faces at side faces on two sides, a casing cover that covers the side wall faces of the shutter, and that covers a shutter bottom edge portion at a position below the shutter face when the shutter is closed, and a chute that includes a water discharge outlet and is disposed to cover the shutter bottom edge portion from below when the shutter is closed.

6 Claims, 6 Drawing Sheets

SHUTTER STRUCTURE AND AUTOMATIC TRANSACTION APPARATUS

TECHNICAL FIELD

The present invention relates to a shutter structure for an automatic transaction apparatus such as an automated teller machine in which a medium such as a banknote is inserted and a specific transaction is performed.

BACKGROUND ART

In an automatic transaction apparatus such as an automated teller machine, generally, a storage section for storing banknotes when performing a money deposit or withdrawal is configured with a structure such that banknotes are housed upright. In such a structure, a shutter of a deposit and withdrawal port has a structure that is either horizontal or slopes down towards the front. With such a shutter structure, sometimes a liquid such as a drink may be splashed on the shutter, or, for an automatic transaction apparatus installed in an external wall, rain water may fall on the shutter (referred to below as water or the like). In such cases, water or the like may ingress into the automatic transaction apparatus through gaps between the shutter and the apparatus casing, and may cause apparatus faults.

Therefore, in a conventional technology described in the publication of Japanese Patent No. 3959297 (paragraph 0046 to paragraph 0061, and FIG. 8 to FIG. 11) a shutter 302 is provided with appropriate inclining, and walls 302*b* and 302*c* are provided at the left and right edges of the shutter 302. Accordingly, in this conventional technology, configuration is made such that water or the like is guided to a water discharge path 315, and the water discharge path 315 is inclined towards a water discharge outlet 317 to raise the water discharge efficiency.

Further, in the conventional technology, a left-right inclined projection 340 is provided at the shutter bottom edge to enable water discharge even for small amounts of rain water, enabling water discharge to be performed along the projection 340. Furthermore, the conventional technology is configured such that, even when water or the like remains on the shutter face that has not been completely discharged, the remaining water or the like tracks along the inclination to the left and right of the projection 340 when the shutter 302 is opened, so as to be discharged into left and right water discharge paths 316*a* and 316*b* (see for example Japanese Patent No. 3959297).

DISCLOSURE OF INVENTION

Technical Problem

However, in the above conventional automatic transaction apparatus shutter structure, the bottom edge of the inclined shutter 302 has a concaved profile below a casing surface 313. Accordingly, in the conventional technology, when a large amount of water or the like, such as from a spilt drink, reaches the shutter face, the only route for discharging water or the like is the water discharge path, and the water discharge path overflows due to having insufficient discharge capability.

In order to address this issue, if the water discharge path 315 was given a greater inclination towards the water discharge outlet 317, extra space would be required to achieve the inclination, with this being deterrent for making the apparatus more compact.

Furthermore, water or the like may remain on the shutter face at overlapping portions, since the bottom edge of the shutter slot into below the casing surface. Consequently, when there is no opening operation of the shutter for a long time, water or the like remains, and may lead to an unsanitary state of the shutter bottom edge.

Solution to Problem

A first aspect of the present invention is an automatic transaction apparatus including: a sloping profile shutter that has side wall faces at side faces on two sides; a casing cover that covers the side wall faces of the shutter, and that covers a shutter bottom edge portion at a position below a shutter face when the shutter is closed; and a chute that includes a water discharge outlet and is disposed to cover the shutter bottom edge portion from below when the shutter is closed.

Advantageous Effects of Invention

According to the automatic transaction apparatus of the first aspect of the present invention, a sufficient water discharge rate may be obtained without enlarging the water discharge structure, such that a situation does not arise in which water discharge cannot keep up, and water or the like may be prevented from remaining on the shutter face.

BEST MODE FOR CARRYING OUT THE INVENTION

Figure 1:
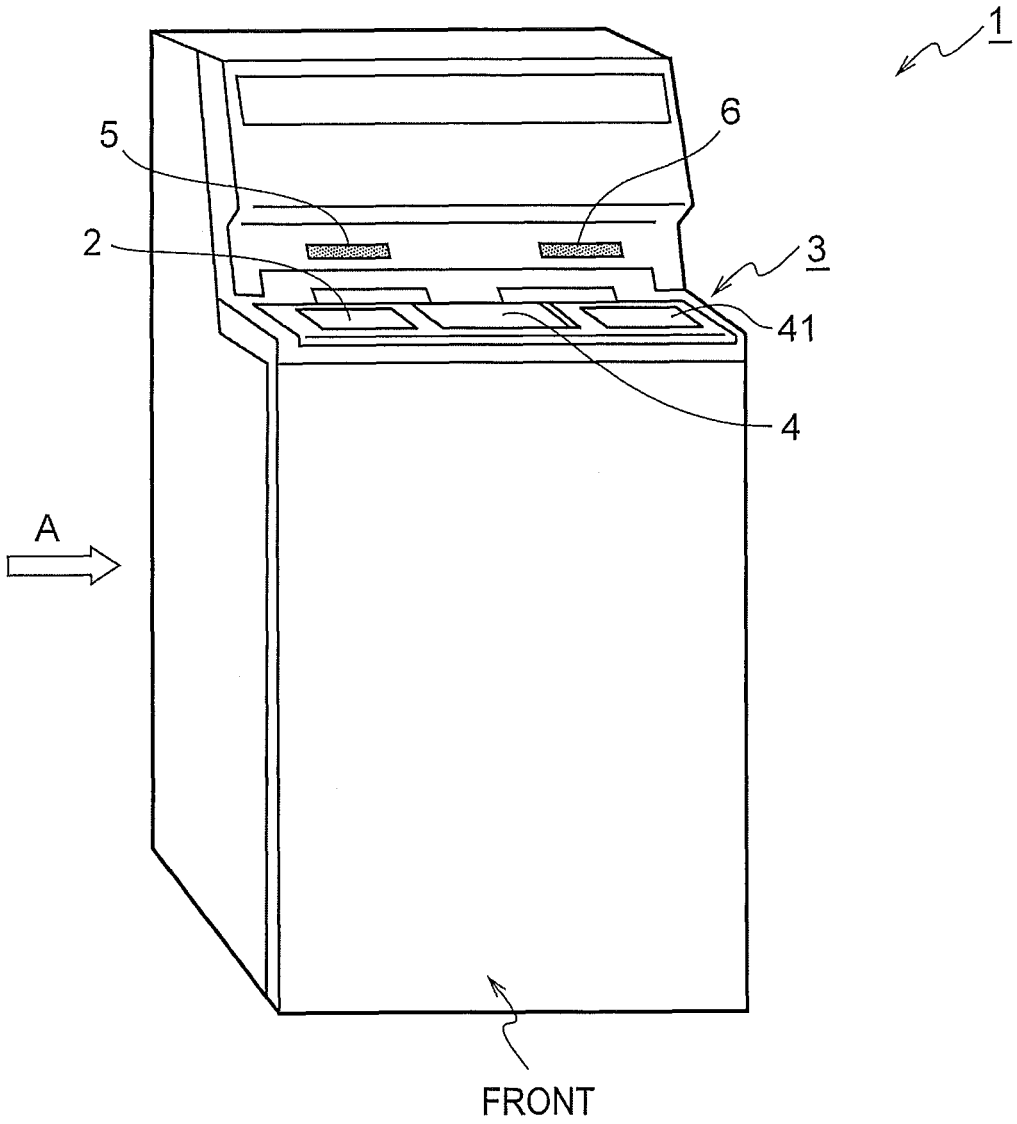
FIG. 1 is a schematic perspective view of an automatic transaction apparatus of a first exemplary embodiment.

Explanation follows regarding an exemplary embodiment of the present invention, with reference to the drawings. The same reference numerals are appended to common elements in the drawings. Note that, in the following explanation of an exemplary embodiment, an example of a shutter for a banknote deposit and withdrawal port will be explained. However, the present invention may also be similarly applied to a shutter such as a coin deposit and withdrawal port shutter.

An automatic transaction apparatus of a first exemplary embodiment has the external appearance as shown in FIG. 1, and is provided with a coin deposit and withdrawal port 2, a banknote deposit and withdrawal port 3, an operation section 4, a passbook insertion slot 5 and a card insertion slot 6.

The coin deposit and withdrawal port 2 and the banknote deposit and withdrawal port 3 are openings for inserting and discharging coins and banknotes, respectively. The coin deposit and withdrawal port 2 and the banknote deposit and withdrawal port 3 are each provided with a shutter 41. The coin deposit and withdrawal port 2 and the banknote deposit and withdrawal port 3 are opened and closed by driving the shutters 41. A coin processing section 25 and a banknote processing section 26 are provided at the back of these sections for performing deposit and withdrawal processing, described later, on coins and banknotes.

A passbook for use in a transaction is inserted into the passbook insertion slot 5, and is discharged from the passbook insertion slot 5 when a transaction has been completed. A passbook processing section 23, described later, is provided at the back of the passbook insertion slot 5. The card insertion slot 6 is a section into which a card is inserted or from which a card is discharged. A card processing section 21, described later, is provided at the back of the card insertion slot 6.

An LCD, for displaying an operation screen during a transaction, and a touch panel, for inputting such items as a transaction selection, a PIN and a transaction amount, are integrally configured in the operation section 4.

Figure 2:
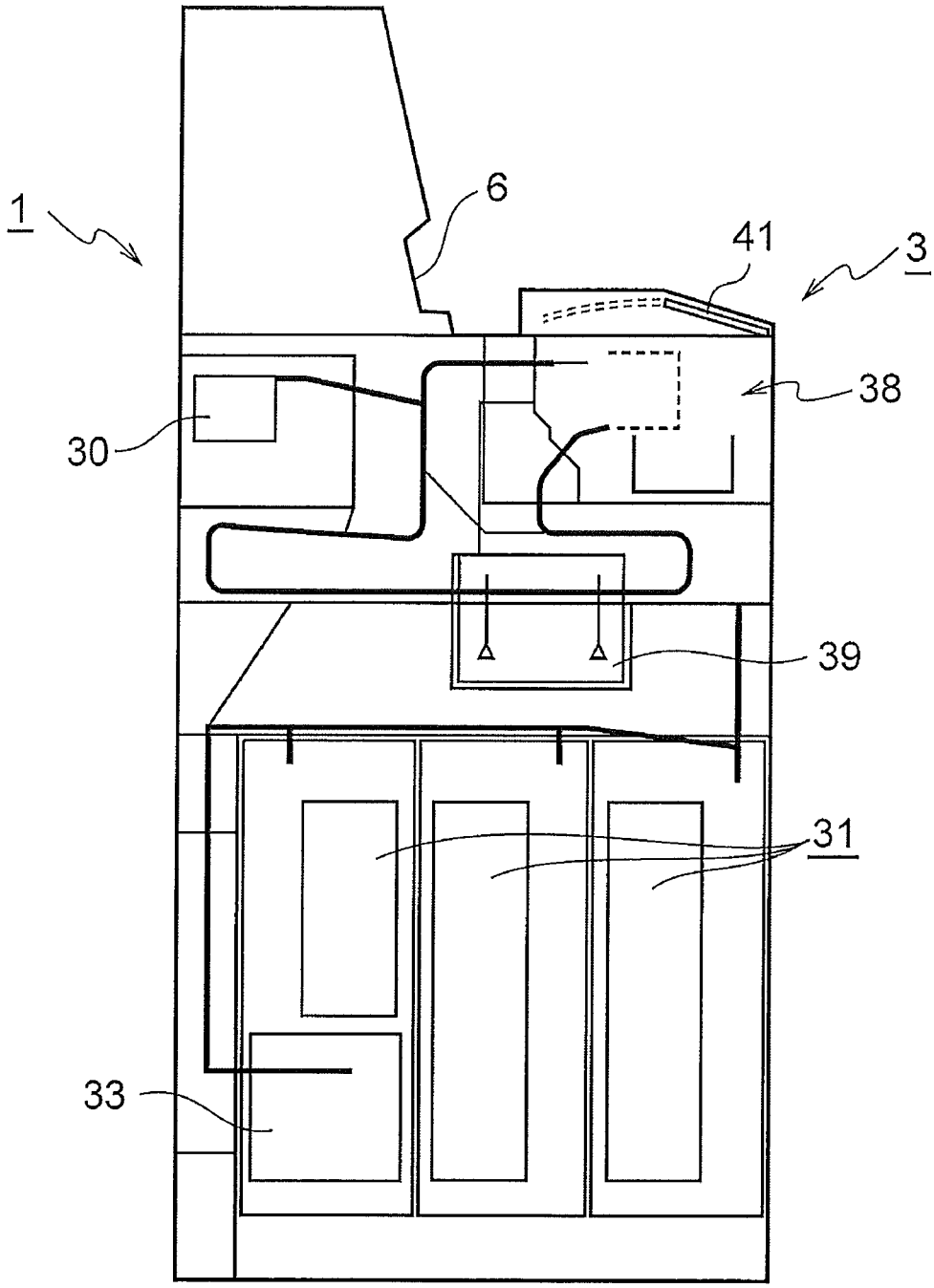
FIG. 2 is a side view of an automatic transaction apparatus of the first exemplary embodiment, as viewed from the arrow A direction of FIG. 1.

FIG. 2 is a side view showing an internal configuration of an automatic transaction apparatus of the first exemplary embodiment, as viewed from the arrow A direction of FIG. 1. Note that, for simplicity, the coin processing section 25 is not illustrated. As shown in FIG. 2, a customer interface section 38, an authentication section 39 and a temporary holding section 30 are provided inside the automatic transaction apparatus of the first exemplary embodiment. Cassettes for specific dominations serving as banknote storage sections 31 are also provided, at the lower side of the apparatus. The customer interface section 38 is configured including such sections as the operation section 4 for user operation and the banknote deposit and withdrawal port 3. The authentication section 39 determines the authenticity of banknotes. The temporary holding section 30 temporarily stores deposited banknotes.

A reject banknote storage section 33 is provided within the automatic transaction apparatus for storing banknotes rejected during scrutiny transactions, and storing reject banknotes not removed by a user.

Figure 3:
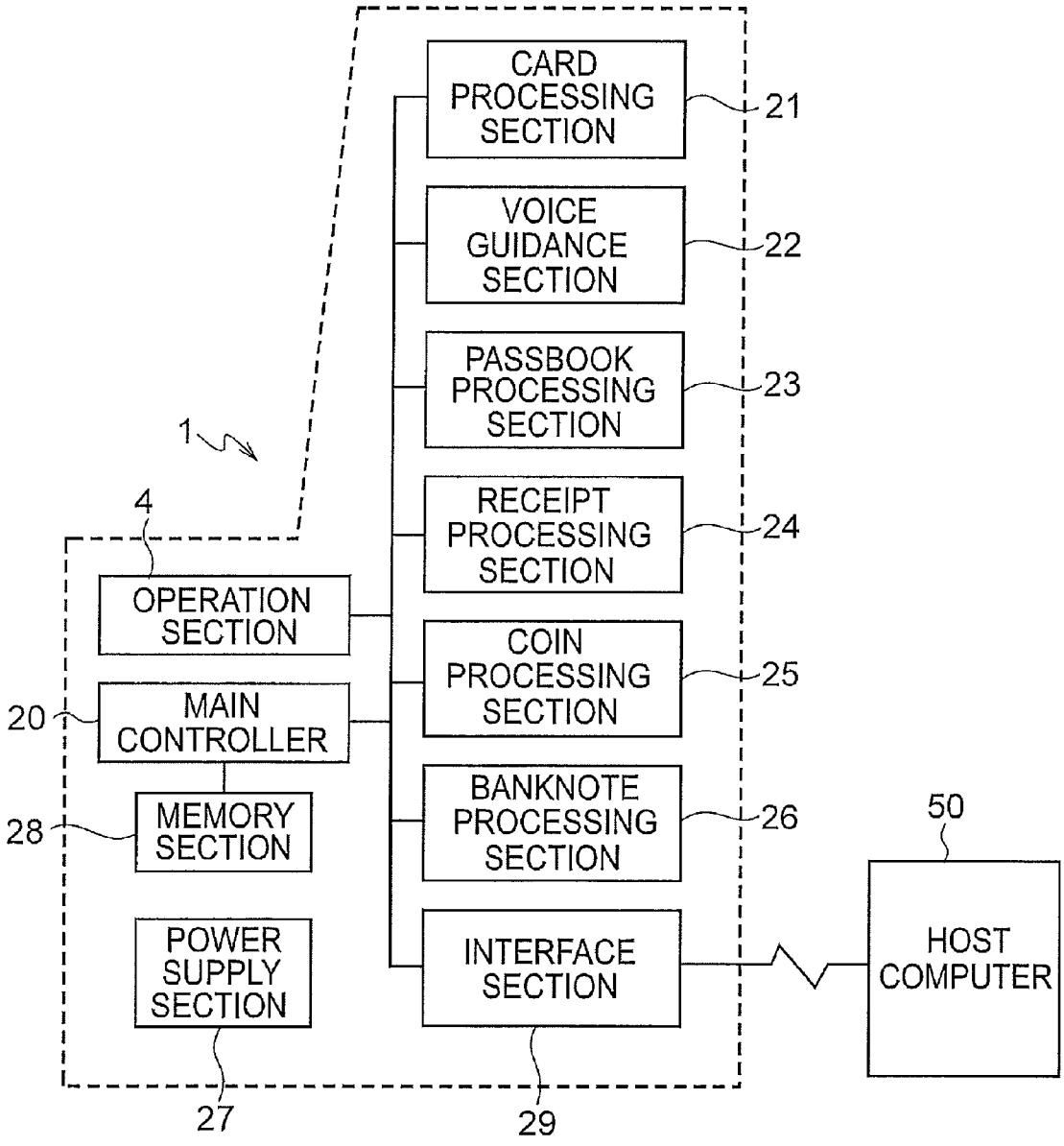
FIG. 3 is a control system block diagram of an automatic transaction apparatus of the first exemplary embodiment.

A main controller 20 and the operation section 4 are provided in the control system of the automatic transaction apparatus of the first exemplary embodiment, as shown in the control system block diagram of FIG. 3. The main controller 20 controls each of the sections, described later. The operation section 4 is for operation by a user according to displayed guidance. Shutter opening and closing operations, described later, are performed under the control of the main controller 20.

Further, the control system of the automatic transaction apparatus of the first exemplary embodiment is provided with the card processing section 21, a voice guidance section 22, a passbook processing section 23, a receipt processing section 24, the coin processing section 25 and the banknote processing section 26. The card processing section 21 performs reading and writing of data, such as account numbers, stored on cards, such as cash cards. The voice guidance section 22 outputs speech such as operational guidance. The passbook processing section 23 performs reading and writing of data, such as account numbers, stored on a magnetic stripe of the passbook, and controls printing in the passbook. The receipt processing section 24 prints out transaction receipts. The coin processing section 25 controls deposit and withdrawal of coins. The banknote processing section 26 controls deposit and withdrawal of banknotes.

Furthermore, a power supply section 27, a memory section 28 and an interface section 29 are provided in the automatic transaction apparatus. The power supply section 27 supplies power to each of the sections. The memory section 28 is a storage section of the main controller 20, and stores various control parameters. The interface section 29 controls the interface with a host computer 50.

Figure 4:
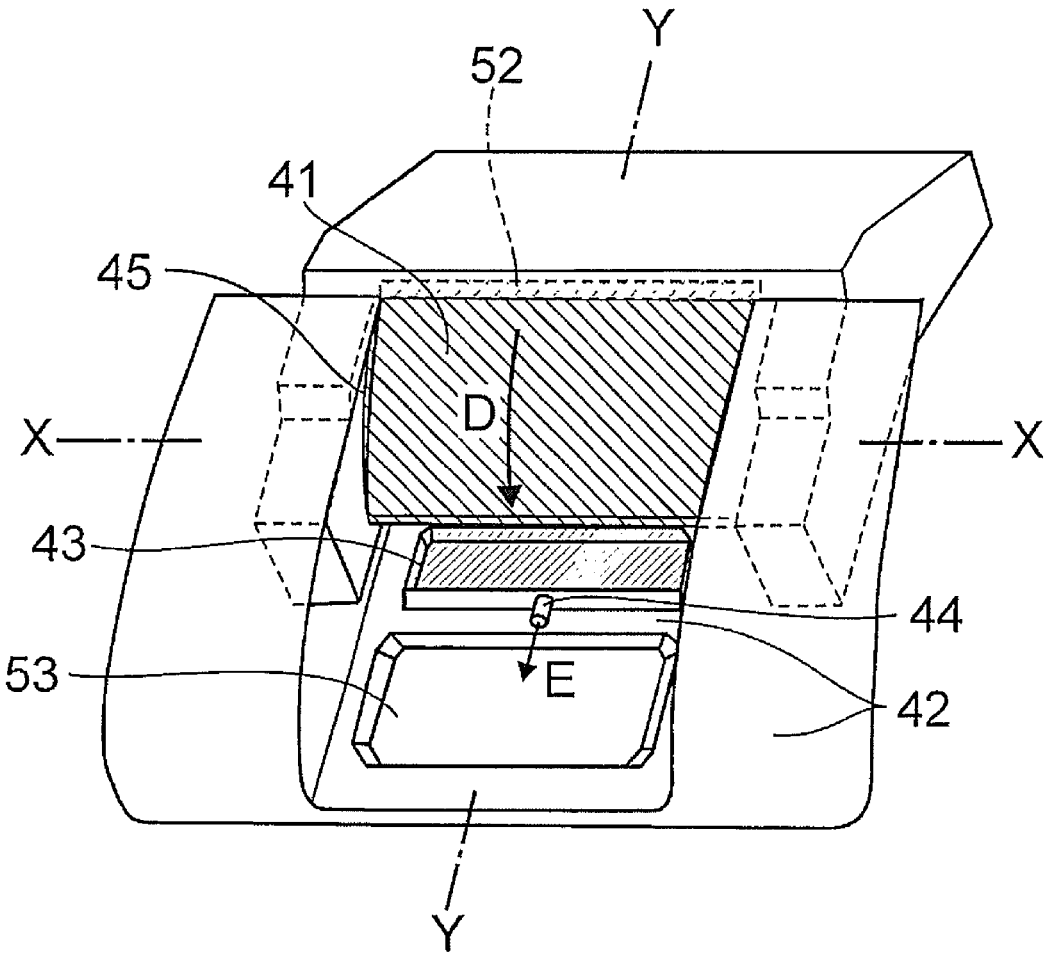
FIG. 4 is a configuration diagram of the vicinity of a shutter of an automatic transaction apparatus of the first exemplary embodiment.
Figure 5:
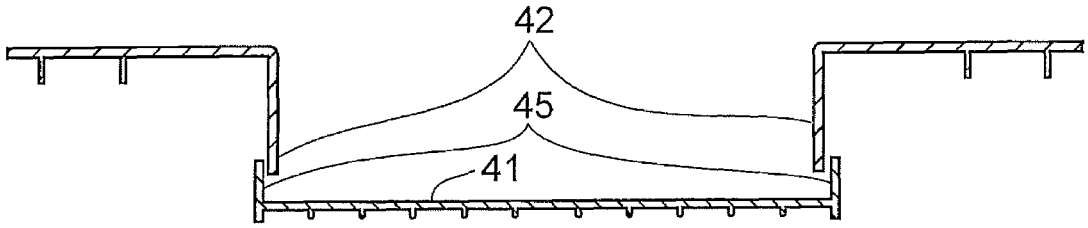
FIG. 5 is a cross-sectional view of an automatic transaction apparatus of the first exemplary embodiment, taken on X-X of FIG. 4.
Figure 6:
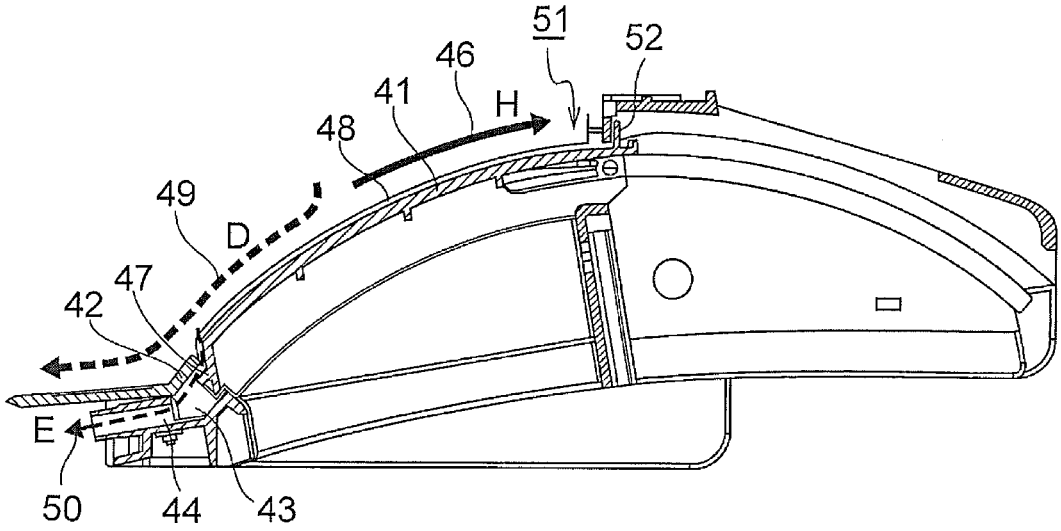
FIG. 6 is a cross-sectional view of an automatic transaction apparatus of the first exemplary embodiment, taken on Y-Y of FIG. 4.

Explanation follows regarding a shutter structure of an automatic transaction apparatus 1 of the first exemplary embodiment, with reference to FIG. 4 to FIG. 6. FIG. 4 is a schematic perspective view of the periphery of a shutter. FIG. 5 is a cross-section taken on X-X of FIG. 4. FIG. 6 is a cross-section taken on Y-Y of FIG. 4.

The shutter 41 of the automatic transaction apparatus 1 of the first exemplary embodiment has a sloping shape, as shown in FIG. 6. The shutter 41 of the automatic transaction apparatus 1 of the first exemplary embodiment has a structure provided with side wall faces 45 at the two side faces of the shutter 41, as shown in FIG. 5, and the side wall faces 45 are covered by the casing cover 42.

As shown at the bottom left of FIG. 6, configuration is made such that a shutter bottom edge portion 47 is covered by the casing cover 42 when the shutter 41 is closed. Accordingly, the casing cover 42 covering the shutter bottom edge portion 47 is positioned lower than a shutter face 48.

A chute 43 is disposed at the bottom side of the shutter bottom edge portion 47. The chute 43 has a water discharge outlet 44, and, at the end of the chute 43, a water collection section 53 is provided for collecting water or the like from the water discharge outlet 44. Note that, the water collection section 53 may not be provided, as long as a configuration is made such that water or the like is guided along the casing, and allows water or the like to fall, without the water collection section 53.

A shutter top edge 51 is a structure including a top edge wall face 52 covered by the casing cover 42.

The shutter 41 of the automatic transaction apparatus of the first exemplary embodiment configured as explained above operates as follows.

First, when a user of the automatic transaction apparatus 1 selects, for example, a banknote deposit transaction with the operation section 4, the shutter 41 of the banknote deposit and withdrawal port 3 is opened under control from the main controller 20, and banknote insertion is prompted. In the operation to open the shutter 41, the shutter bottom edge portion 47 is moved upwards as shown by arrow H of the shutter operation 46 in FIG. 6.

Then, at once, the shutter 41 is closed and the deposited banknotes are counted, and is completed when the counting shows no errors. The operation here to close the shutter 41 is the reverse of the opening operation described above for opening, and the shutter bottom edge portion 47 moves in the opposite direction to arrow H. The shutter 41 maintains the closed state of FIG. 6 when deposit transactions such as this are not being performed. As a result, the automatic transaction apparatus of the first exemplary embodiment prevents water or the like, such as rain water and drinks, flowing into the inside of the apparatus.

As shown in FIG. 5, the side wall faces 45 are provided at the side faces of the shutter 1 in the first exemplary embodiment. Consequently, when the shutter 41 is in a closed state, if water or the like splashes onto the shutter face 48, water or the like flows downwards along the sloping shape of the shutter face 48.

The shutter bottom edge portion 47 at this time is covered by the casing cover 42 that is a lower face than the shutter face 48. Accordingly, most of the water or the like is discharged through a main water path 9 facing, as shown by arrow D in FIG. 6, from the shutter face 48 towards the casing cover face.

Remaining water or the like flows into the chute 43 covering the bottom face of the shutter bottom edge portion 47, and is discharged through an auxiliary water path 50 towards the water discharge outlet 44 provided to the chute 43.

The shutter structure of the automatic transaction apparatus 1 of the first exemplary embodiment is operated as described above. Consequently, the automatic transaction apparatus of the first exemplary embodiment may obtain a sufficient water discharge without requiring a bulky water discharge structure, a situation does not arise in which water discharge cannot keep up, and may prevent water or the like being remained on the shutter face 48.

The automatic transaction apparatus of the first exemplary embodiment is configured with a structure in which the shutter top edge 51 is also provided with the top edge wall face 52, and the top edge wall face 52 is covered by the casing cover 42. Consequently, in the automatic transaction apparatus of the first exemplary embodiment, water or the like does not flow into the apparatus from the shutter top edge 51 sides, even when the horizontal profiled shutter 41 is sloped with only a small inclination.

Due to operation as described above, even if water or the like such as sugary drinks are spilt over the shutter 41 of the automatic transaction apparatus of the first exemplary embodiment and the spilt sugary drinks splash onto the shutter 41, the sugary compounds can be washed away by pouring on a large amount of water.

As explained in detail above, the automatic transaction apparatus of the first exemplary embodiment includes: a sloping profile shutter that has side wall faces at side faces on two sides; a casing cover that covers the side wall faces of the shutter, and that covers a shutter bottom edge portion at a position below the shutter face when the shutter is closed; and a chute that includes a water discharge outlet and is disposed to cover the shutter bottom edge portion from below when the shutter is closed. Consequently, the automatic transaction apparatus of the first exemplary embodiment may obtain a sufficient water discharge without requiring a bulky water discharge structure, a situation does not arise in which water discharge cannot keep up, and may prevent water or the like from being remained on the shutter face.

INDUSTRIAL APPLICABILITY

As described above, the present invention may be widely employed in an automatic transaction apparatus, such as an automated teller machine, with a shutter that is opened and closed, a medium such as a banknote is inserted and specific transactions are performed.

The invention claimed is:

1. A shutter structure comprising:

a sloping profile shutter including:

side wall faces disposed at side faces on two sides, and a shutter bottom edge portion having a face that extends in a direction toward a back face of the shutter; and a casing cover that covers two side wall faces and a portion of the face of the shutter bottom edge portion;

wherein a face of the casing cover that is disposed at the vicinity of the shutter bottom edge portion is disposed at a position that is offset in the direction toward the back face of the shutter, relative to the overall shutter face, when the shutter is closed.

2. The shutter structure of claim 1, wherein a wall face is provided at the top edge of the shutter such that the wall face is covered by the casing cover.

3. An automatic transaction apparatus comprising the shutter structure of claim 2.

4. An automatic transaction apparatus comprising the shutter structure of claim 1.

5. The shutter structure of claim 1, further comprising a chute disposed to cover the shutter bottom edge portion from below when the shutter is closed.

6. The shutter structure of claim 5, wherein the chute includes a water discharge outlet.

* * * * *